United States Patent [19]

Stegmeier

[11] Patent Number: 4,815,888

[45] Date of Patent: Mar. 28, 1989

[54] SWIMMING POOL DRAIN

[76] Inventor: William J. Stegmeier, 3313 Ambassador Row, Arlington, Tex. 76013

[21] Appl. No.: 140,827

[22] Filed: Jan. 5, 1988

[51] Int. Cl.[4] ..... E01C 11/22

[52] U.S. Cl. ..... 404/4; 404/72; 52/169.7; 4/510; 210/164

[58] Field of Search ..... 404/2, 3, 4, 72; 405/118; 52/12, 169.7; 210/163, 164; 4/510

[56] References Cited

U.S. PATENT DOCUMENTS

| | | | |
|---|---|---|---|
| 2,208,000 | 7/1940 | Geyer | 404/2 |
| 2,370,647 | 3/1945 | Fischer | 404/49 |
| 2,967,467 | 1/1961 | Maude | 404/66 |
| 3,411,260 | 11/1968 | Dill | 52/573 |
| 3,465,654 | 9/1969 | Fox | 404/4 |
| 3,868,797 | 3/1975 | Fox et al. | 52/73 |
| 3,876,322 | 4/1975 | Deason | 404/2 |
| 3,896,597 | 7/1975 | Deason | 52/396 |
| 4,007,566 | 2/1977 | Molitor | 52/169.7 |
| 4,365,911 | 12/1982 | Rossberg | 404/2 X |
| 4,490,067 | 12/1984 | Dahowski | 404/4 |
| 4,522,531 | 6/1985 | Thomsen et al. | 404/2 |
| 4,603,521 | 8/1986 | Engelhart | 52/169.7 X |
| 4,648,739 | 3/1987 | Thomsen | 404/2 |

FOREIGN PATENT DOCUMENTS

| | | | |
|---|---|---|---|
| 2456169 | 1/1981 | France | 404/4 |

*Primary Examiner*—Jerome W. Massie, IV
*Assistant Examiner*—Matthew Smith
*Attorney, Agent, or Firm*—Daniel Rubin

[57] ABSTRACT

A polymer plastic drain apparatus for the aggregate decking areas of a swimming pool. The drain is comprised of an elongated trough adapted for burial in the aggregate and is formed of a bottom wall and parallel spaced apart upright sidewalls terminating at their upper distal ends in a bifurcated formation defining an intervening space of selected cross-section. Adapted to overlie the trough in a removable mounting relation thereto is an apertured grating having elongated skirts downwardly depending from the longitudinal edges thereof. The skirts are insertable within the intervening spacing of the bifurcated trough formation in a spring-like interfit enabling the grating to be removed and replaced as appropriate. Internally of the trough are a plurality of longitudinally spaced transversely arranged sleeves extending between openings in the opposite sidewalls. The sleeves enable reinforcing rods to be implaced and embedded in the decking aggregate when poured and serve to anchor the trough in place within the aggregate when set while inhibiting expansion and contraction of the decking in the areas surrounding the drain.

16 Claims, 1 Drawing Sheet

SWIMMING POOL DRAIN

TECHNICAL FIELD

The field of art to which the invention pertains comprises the art of mechanical drainage in decking areas about a swimming pool for receiving rain runoff and water overflow to be disposed of.

BACKGROUND OF THE INVENTION

In the construction of swimming pools with relatively vast amounts of concrete decking, it is common to conduct runoff of rain water and/or overflow to a suitable surface level drain fixedly set within the decking at selected locations. The decking surface is normally pitched toward the drain which via its subsurface conduit conveys the drain water to a remote discharge location where the drain water can be disposed of either by dumping on the ground or by connection to an underground conduit. Exemplifying continuous elongated drains of this type are the disclosures of U.S. Pat. Nos. 3,465,654 and 3,876,322.

While the drainage systems disclosed by the foregoing patents have generally functioned well for the purpose of conducting rain runoff from the decking away from the perimeter of the pool, they are known to have proven deficiences that render them troublesome and undesirable from the standpoint of maintenance and service. Typically, the prior art drains of the aforesaid type are constructed almost entirely of polymer plastic composition. The grating area is exposed and comprises an integral part of, or which during installation becomes a permanent part of, the underlying drain trough. In that relation, the trough portion remains buried in the decking, while the surface grating is continuously exposed to sunlight containing ultraviolet light (U.V.). Over a period of several years the U.V. adversely affects the plastic grating composition causing the exposed grating to gradually deteriorate until repair becomes necessary.

Being that the grating is however not per se separately removable, repair can involve removing entire sections of drain including the trough portions and at least the adjacent concrete for which the cost can prove disproportionately prohibitive. For the same reason, cleaning the drain trough of leaves or other debris tending to collect within the trough can prove most difficult if not nearly impossible to perform effectively. That is, without a ready access at various locations along the drain, clean out via the use of conventional implements or even a garden hose for effecting wash down can represent a major hassle in the maintenance of such drains.

Yet another problem has been the adverse effects of expansion and contraction of the decking concrete and soil shifting on the secured drain enabling the drain to function as an expansion joint. It is not uncommon for the secured decking to be strained or crushed beyond its yield limit as the surrounding concrete is caused to contract and expand in response to ambient temperature swings.

Despite recognition of the foregoing, a ready solution therefore had not heretofore been available.

SUMMARY OF THE INVENTION

This invention relates to drain apparatus for draining water runoff from the concrete decking areas in and about swimming pools. More specifically, the invention relates to a novel form of continuous elongated drain that eliminates many of the maintenance problems presently associated with the similar purpose drain constructions currently available. Not only does the drain construction of the invention readily resolve the foregoing maintenance problems but it achieves that result at a highly competitive cost of fabrication as compared to the drain constructions commercially available for that purpose.

To effect the foregoing in accordance with the invention, the drain construction hereof is constructed of an all polymer plastic composition such as polyvinylchloride (PVC) formed of longitudinally joined sections. Each section includes longitudinal side and bottom walls defining a trough adapted normally to be buried within the concrete decking below grade. At the upper distal ends of each of the trough sidewalls extending longitudinally coextensive therewith are substantially upright bifurcated lips defining an intervening space of selected cross sectional configuration. The grate section is adapted to be positioned at grade level superposed over the trough section and includes integral downwardly depending skirts extending along each longitudinal edge. The skirts are individually configured to provide them a springlike quality and are adapted for assembly to the trough by insertion in a spring grasp between the lips of the sidewalls and from which they are readily removable when desired. Being that the grating is readily detachable from the buried trough, the various grating sections can be conveniently replaced at the onset of ultraviolet deterioration without disturbing the trough and/or the adjacent concrete. Likewise, the grating can be selectively removed wherever and whenever cleanout of the drain is contemplated.

A further feature of the invention resides in the provision of tubular grommets extending transversely between openings in the sidewalls at longitudinally spaced locations. By means of the grommets, steel reinforcing bars can be placed transversely through the trough so as to be protected from water in the trough while enabling the trough to be directly anchored in the concrete decking when poured. Being that the drain is directly anchored in the immediately surrounding concrete, expansion and contraction thereof is controllably caused to occur elsewhere in a location remote from the drain so as to per se protect the drain from the adverse effects thereof.

It is therefore an important aspect of the invention to provide a novel drain apparatus for surface collection of water runoff.

It is a further important aspect of the invention to effect the previous aspect with a drain apparatus particularly suited for aggregate type swimming pool deckings and affording enhanced maintenance features as compared to similar purpose drain constructions of the prior art.

It is a still further important aspect of the invention to effect the previous aspects with a drain apparatus that is cost competitive as compared to existing drain structures therefor yet affording the virtues of readily replaceable gratings and clean out access without the attendant difficulties and high maintenance costs associated with the prior art constructions.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
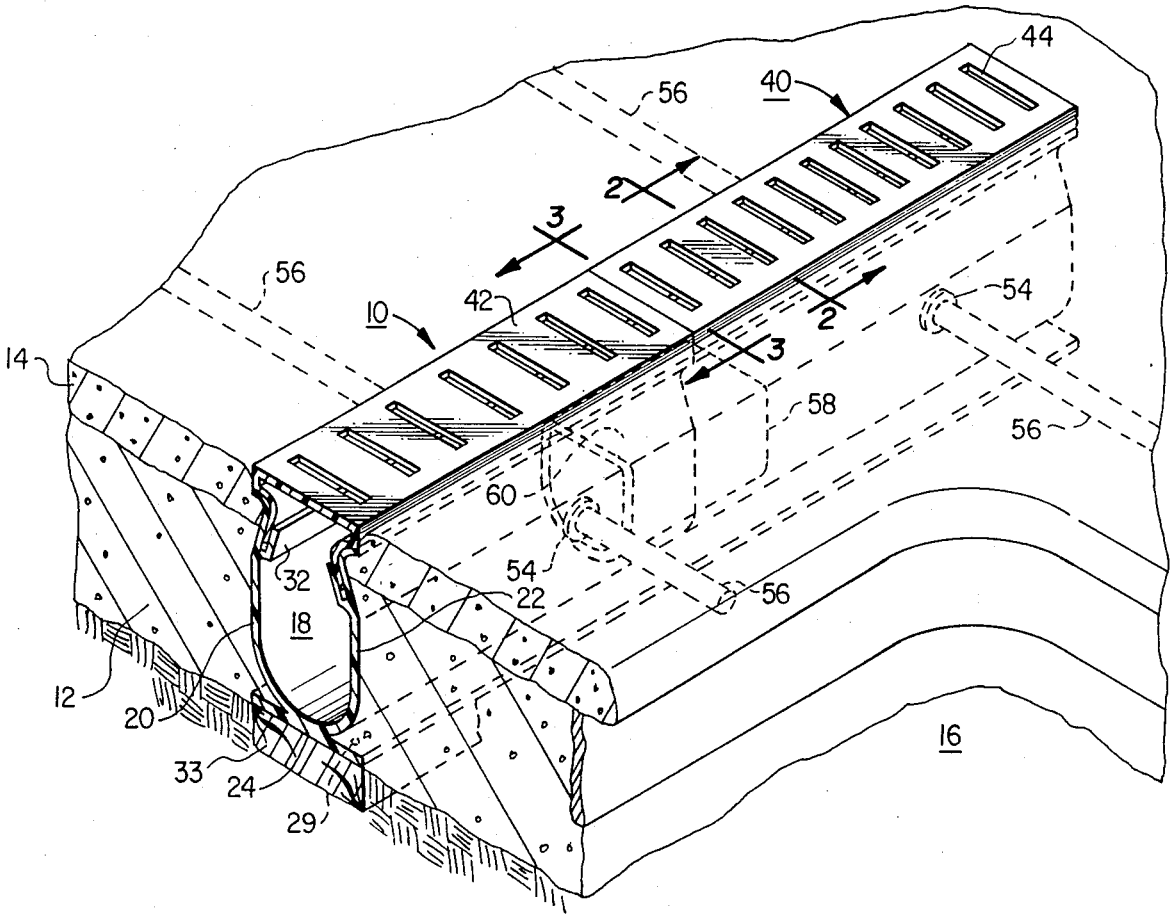
FIG. 1 is an isometric view of a drain apparatus hereof as installed in a swimming pool decking.
Figure 2:
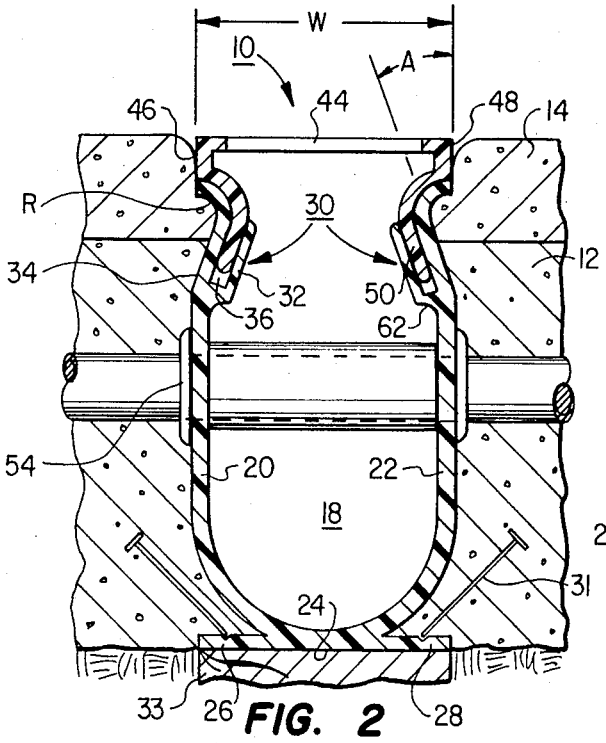
FIG. 2 is a sectional elevation as seen substantially from the position 2—2 of FIG. 1.

In the description which follows, like parts are marked throughout the specification and drawings with the same reference numerals respectively. The drawing figures are not necessarily to scale and in certain views parts may be drawn rotated into the plane of the drawing for purposes of clarity.

Referring now to the drawings, the drain apparatus hereof is designated 10 and is shown secured in an aggregate based decking 12 including an aggregate finished decking overlay 14 extending about an in ground swimming pool 16. For purposes hereof, the drain 10 is substantially if not completely constructed of a polymer plastic composition such as PVC that is suitable for concrete emplacement in the manner as will be described.

Comprising the drain 10 hereof and adapted for direct burial in the aggregate deckings 12 and 14 is an elongated U-shaped trough section 18 comprised of parallel spaced apart upright sidewalls 20 and 22 of about ⅛ inch thickness and defining an internal flow width between the sidewalls of about 1½ inches. At the underside of the trough there is included an integral longitudinally extending flat plate 24 having extensions 26 and 28 extending laterally from the integral joinder at each of the sides. For initially securing the trough in place each of extensions 26 and 28 include a plurality of notches 29 through which nails 31 can secure the trough to ground stakes 33.

The sidewalls 20 and 22 are adapted to be positioned in a generally upright orientation and at their upper distal ends terminate in a longitudinally extending bifurcated formation 30. The latter formation is comprised of an inner lip 32 and a spaced outer lip 34 defining an intervening space 36. Each of the formations 30 include an offset inwardly inclined orientation at an angle A from the vertical of about 20 degrees. The outer lip 34 thereof also extends upwardly beyond the inner lip 32 at which location lip 34 curls outward to the exterior plane of the sidewalls at a radius R on the order of about ¼ to ½ inch.

Adapted for detachable mounting overlying the trough 18 is an elongated grating 40 having an upper surface 42 defining a plurality of longitudinally spaced drainage apertures 44. Like trough 18, grating 40 is of a PVC composition of about ⅛ inch thickness. When mounted on trough 18 the grating is received in deck opening 45 with its surface 42 substantially co-planar with the adjacent surface grade of decking 14 thereat. For detachable mounting of the grating 40 onto the trough 18, the longitudinal side edges 46 and 48 of the grating 40 each include below their vertical orientation an inwardly curved longitudinal skirt 50 of about 1/16 inch thickness downwardly depending and adapted for insertion in an interference friction fit into the opposite spacings 36 between lips 32 and 34. The inward curve of the skirts complement the outer radius of lip 34 and being constructed in the foregoing manner, each of the skirts 50 are afforded a degree of springlike resilience from their connection with their respective side edges. By virtue of the springlike resiliency afforded thereby and the upper arcuate section thereof formed generally complementary to the outer radius of the lips 34 the skirts are easily insertable into spaces 36 between the inner and outer lips 32 and 34 of bifurcated formation 30. Insertion of the skirts imposes a spring grip relation between the lips and skirts thereat within the opposite spaces 36. With a width dimension W of the grating 40 just slightly less than the comparable dimension of cavity 45 provided therefor in the decking overlay 14, the grating can be snapped into a secured position on trough 18 or removed from trough 18 almost at will.

In order to anchor the unit in place within decking 12 so as to minimize or eliminate any contraction and/or expansion in the decking areas contiguous to the drain there is provided in trough 18 a plurality of longitudinally spaced apart tubular sleeves 52. The sleeves extend through the sidewalls from a joinder thereat by means of an annular flange 54 positioned flush against the exterior face of the sidewalls. Adapted to be received within each sleeve 52 for transverse placement within decking 12 prior to the decking being poured is a reinforcing rod 56 that functions in a well known manner when the decking aggregate is set. Any suitable number and spacings of reinforcing rods 56 can be utilized for the installation and typically are provided at a longitudinal spacing of about 24 to 30 inches. The sleeve 52 in this relation serves to protect the reinforcing rod against the corrosive effects of water contained in trough 18, while the reinforcing rods serve to securely anchor the trough in its intended orientation within the adjacent decking 12. Being anchored in that manner causes expansion and contraction of the concrete to controllably occur elsewhere in areas removed from the drain. This avoids the forces thereof from being imposed against the drain per se.

Figure 3:
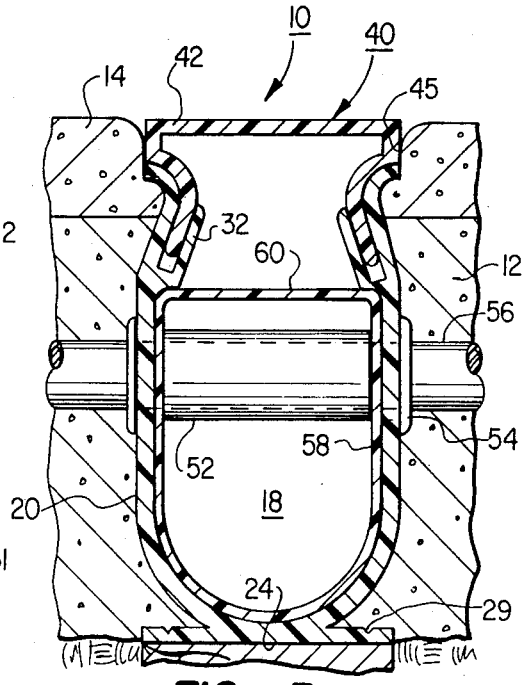
FIG. 3 is a sectional elevation as seen substantially from the position 3—3 of FIG. 1.

Each individual section of drain 10 including the coterminous trough 18 and grating 40 are typically about ten feet in length and can of course be cut on site to a reduced length. Where increased length is required, tandem sections are utilized and for which the sections are coupled by means of a tubular coupler 58. As best seen in FIG. 3, coupler 58 is configured for a complementary interfit within trough 18 and includes a longitudinal top wall 60 positioned in a snap in relation within opposite coves 62 formed at the underside of bifurcated formations 30.

During installation, the trough section 18 with grating 40 in place and aperture 44 taped is generally arranged in the decking area by means of nails 31 and stakes 33. With reinforcing rods 56 disposed in sleeves 52 the decking is poured so that the trough will be buried within decking 12 after the decking aggregate is set. Overlay decking 14 is placed thereon to include a surface opening 45 extending the length of trough 18 and sized to permit removal of grating 40. Once the respective aggregates have completely set, grating 40 can be removed and reinserted onto trough 18 by first squeezing the skirts 50 slightly toward each other so as to be engageable with the backface of lip 34. At that point the skirts can be conveniently inserted inward of spacings 36 while springing outward against the outer radius of lip 34. At such time as the skirts are fully engaged in the complementary overfit with lip 34, installation mounting of the grating is completed.

When UV deterioriation of the grating 40 eventually occurs after a number of years of sun exposure to the surface 42, the affected grating portion(s) can be conveniently snapped out of the foregoing relation by withdrawing the grating upward. Following removal, the defective grating is then replaced by a similar grating component that is secured to trough 18 as described above. For these purposes the grating can be removed and replaced without disturbing the trough 18 or the adjacent decking aggregate in the manner of the prior art. Being simple to place and remove, the removable grating substantially enhances the maintenance features associated with the drain by enabling the quality and appearance of the drain to be maintained at a minimum cost and without the need for special equipment. Similarly, at such time as clean out of the drain is required either by hosing or use of cleaning implements, the grating 40 can be removed to provide access to trough 18 in order to vacuum or otherwise remove refuse or other debris as may have collected in the trough.

By the above description there is disclosed a novel drain construction apparatus for swimming pool deckings that affords substantial improvement in eliminating many of the maintenance problems presently associated with the similar purpose drain constructions of the prior art yet the drain can be fabricated at a competitive cost of production. The feature of a removal grating enables convenient replacement of the grating from the adverse effects of ultraviolet exposure while rendering the drain more easily cleanable by providing a more direct access to leaves and other accumulated debris within the drain trough. This is achieved without the inconvenience, difficulties and attendant expense for effecting maintenance in similar purpose drain constructions of the prior art. By virtue of the springlike grasp of the bifurcations imposed against the received skirts of the grating, the gratings remain secured firmly in place until such time as they are forceably removed intact for whatever reason with a minimum of effort. Use of the anchoring system hereof serves to maintain the integrity of the drain by substantially if not completely eliminating the adverse contraction and expansion effects imposed by the adjacent concrete against the drain structure.

Since many changes could be made in the above construction and many apparently widely different embodiments of this invention could be made without departing from the scope thereof, it is intended that all matter contained in the drawings and specification shall be interpreted as illustrative and not in a limiting sense.

What is claimed is:

1. A drain apparatus for receiving and conducting surface drainage from a site in which the apparatus is installed;

a body of polymer plastic composition defining an elongated trough adapted for burial below grade at the site of installation; and a grating of polymer plastic composition adapted to be removably mounted in an interference fit on said trough at grade level of the drainage site and including a plurality of apertures communicating inward with said trough in a drain flow relation therewith.

2. A drain apparatus in accordance with claim 1 in which said trough and said grating include cooperating means for mutually effecting said interference fit between said grating and said trough.

3. A drain apparatus in accordance with claim 2 in which said trough is comprised of a longitudinal section having a bottom wall and parallel spaced apart generally upright sidewalls and the cooperating means on said trough is comprised of first cooperating means extending longitudinally along the uppermost distal end of said sidewalls and the cooperating means of said grating is comprised of a second cooperating means adapted to mutually interfit with said first cooperating means for cooperatively effecting said interference fit between said grating and said trough.

4. A drain apparatus in accordance with claim 3 in which one of said first and second cooperating means comprises a substantially vertically oriented bifurcated formation defining an intervening space of selected geometric cross-section and the other of said first and second cooperating means includes a substantially vertically oriented skirt adapted for insertion within said intervening spacing for effecting said interference fit.

5. A drain apparatus in accordance with claim 4 in which said substantially vertical orientation includes an arcuate portion on which a portion of said skirt and a portion of the bifurcated formation complementarily overlie one on the other.

6. A drain apparatus in accordance with claim 4 in which said skirt is characterized as having a springlike flexibility in the lateral direction for effecting said interference fit within said intervening spacing.

7. A drain apparatus in accordance with claim 6 in which said bifurcated formation extends longitudinally along the upper distal edges of the sidewalls of said trough and said skirt downwardly depends from each longitudinal side edge of said grating.

8. A drain apparatus in accordance with claims 1 or 7 in which the site for installing said drain apparatus comprises the aggregate decking about a swimming pool and there is included anchoring means to effect anchoring the trough within the aggregate.

9. A drain apparatus in accordance with claim 8 in which said anchoring means includes a plurality of longitudinally spaced sleeves transversely arranged internally of said trough between openings in the opposite sidewalls of said trough for defining a plurality of individual enclosures secured between said sidewalls and each of said sleeves is adapted to receive a transversely arranged reinforcing rod extending beyond said sidewalls to be embedded in the surrounding aggregate.

10. A drain apparatus in accordance with claim 9 in which said sleeves are of a polymer plastic composition.

11. A drain apparatus in accordance with claim 4 including coupler means for securing tandem sections of the drain.

12. A method of inhibiting expansion and contraction of concrete in areas of the concrete contiguous to a drain embedded in the concrete, comprising the steps of:

providing an elongated drain having a body defining a trough to be embedded in the concrete and a grating adapted for removable mounting in an interference fit on said trough;

providing sleeves arranged transversely within said drain trough between apertures defined in opposite sidewalls of said trough;

placing a reinforcing bar within each of said sleeves of length extending laterally beyond the sidewalls of said trough;

securing said trough in position at the site of installation; and pouring the aggregate concrete mix about said secured trough and reinforcing bars.

13. A method in accordance with claim 12 in which said sleeves are provided at longitudinally controlled spacings within said drain trough.

14. A method in accordance with claim 13 in which said sleeves are secured to the opposite sidewalls of said drain trough in a substantially water-tight relation relative to drain water in said trough.

15. A drain apparatus in accordance with claim 2 in which the uppermost surface of said trough terminates a selected distance below grade level, said grating includes side edges of a height substantially equal to said selected distance and the cooperating means of said grating extends downwardly dependent from said side edges for effecting said interference fit with the cooperating means of said trough.

16. A drain apparatus in accordance with claim 15 in which the cooperating means of said trough and grating have sectional configurations defining discrete offsets shaped to complementary interfit with each other in said interference fit.

* * * * *